US006061912A

United States Patent [19]

Gazaway

[11] Patent Number: 6,061,912

[45] Date of Patent: May 16, 2000

[54] INSTRUMENT FOR CUTTING MULTI-STRAND PLASTIC FIBER MATERIALS

[76] Inventor: Eileen L. Gazaway, 1159 Palomino Ct., Tracy, Calif. 95376

[21] Appl. No.: 09/162,859

[22] Filed: Sep. 29, 1998

Related U.S. Application Data

[60] Provisional application No. 60/064,360, Oct. 30, 1997.

[51] Int. Cl.[7] ..... A45D 26/00

[52] U.S. Cl. ..... 30/140; 30/124; 30/254; 132/225; 132/269; 219/223; 219/227

[58] Field of Search ..... 30/140, 124, 254; 219/223, 225, 227; 132/225, 269

[56] References Cited

U.S. PATENT DOCUMENTS

| | | | |
|---|---|---|---|
| 4,516,574 | 5/1985 | Hewes, Jr. | 30/140 |
| 4,587,968 | 5/1986 | Price | 30/140 |
| 4,662,068 | 5/1987 | Polonsky | 30/124 |
| 5,309,640 | 5/1994 | Caron | 30/140 |
| 5,743,017 | 4/1998 | Dreher et al. | 30/140 |
| 5,783,800 | 7/1998 | Thompson et al. | 30/140 |

FOREIGN PATENT DOCUMENTS

| | | | |
|---|---|---|---|
| 2407797 | 7/1979 | France | 30/140 |

*Primary Examiner*—Hwei-Siu Payer
*Attorney, Agent, or Firm*—Hickman Stephens Coleman & Hughes, LLP

[57] ABSTRACT

A cutting interment (10) for use on multi-strand plastic fiber materials. Opposed handles (22*a* and 22*b*) on arms (18*a* and 18*b*) may be manually operated to close jaws (14*a* and 14*b*) with a cavity (42) for crimping. At the base of the cavity (42) are cutting edges (52*a*), which employ heat from either heating elements (54*a* and 54*b*) or an external source to cut and simultaneously cauterize the cut ends. Optional reliefs (44 and 46) may also be provided to contain and focus the heat at the cavity (42) and thus efficiently apply it specifically to the working material.

12 Claims, 6 Drawing Sheets

INSTRUMENT FOR CUTTING MULTI-STRAND PLASTIC FIBER MATERIALS

This application claims benefit of U.S. provisional application serial number 60/064,360, filed Oct. 30, 1997.

TECHNICAL FIELD

The present invention relates generally to cutting tools, and more particularly to an instrument for simultaneously crimping, cutting, and cauterizing multi-strand plastic fiber materials such as braided strands of synthetic hair and synthetic ropes.

BACKGROUND ART

In place of long used natural materials, such as animal hair and agriculturally grown fibers, our society is increasingly now using multi-strand plastic fiber materials. One example is braided synthetic hair. In fact, this example is one particularly indicative of the growing importance of synthetic fibers as our ability to manufacture them in high quality and having particular aesthetic characteristics improves . Such "hair" is a popular cosmetic accessory, being much more economical and generally easier to care for than natural human or animal hair equivalents. Another example is plastic fiber based synthetic rope. This is very widely used in industry today. Such plastic rope has largely come to replace natural hemp based rope due to its low cost, high strength and superior resistance to deterioration from chemical and other organic agents, like mildew.

While such synthetic materials have become popular for many uses, they are still largely handled as are the older materials which they replace. For example, the ends of natural hair braids and of hemp rope fray. This requires special handling, usually involving tying off the ends in some manner.

However, when multi-strand plastic materials are used instead, particularly if they have thermoplastic characteristics, other options are possible. For example, one can cauterize a multi-strand end, effectively making it into a single end. Today hairdressers working with synthetic hair braids and sailors working with rope will commonly hold a recently cut end tightly and apply heat from the flame of a cigarette lighter to it to perform just such cauterization. Further, they will often attempt to compress the end during such cauterization by removing the flame and squeezing the end with their fingers.

Unfortunately, these methods have a number of disadvantages. If the end is first cut, it has to be tightly held until cauterization is complete. Of course, the material can simply be burned through to make the end, thus combining both cauterization and cutting into one operation. But this, and even conventional cutting, when combined with too close application of a flame is not always wise around plastic materials, which can give off dangerous fumes and even catch fire themselves. Further, even when this does work, it may result in an unattractive end. Thus, whichever method of cutting is used, compression is often also desired, to insure that the fused end stays together or to improve its aesthetic appearance. As noted, the presently preferred tool for this is the fingers, usually after one has licked them to reduce the likelihood of burning ones self, but which all too frequently happens anyway.

There have been attempts to create tools to assist in cutting, cauterizing and compressing multi-strand plastic fiber materials. Hot knife and wire systems are commonly used in high volume production line systems, like industrial bailing machines. But these are generally not hand held, and they overwhelmingly are used to bond the cut end to other portions of the material itself, rather than merely cutting, cauterizing and compressing and open end of it.

For simple end cutting, one instrument currently available in the market which is known to the present inventor is essentially a pair of opposed pre-heated blades. This instrument is heated in an oven and then applied to the synthetic material to compressably cut through it, concurrently cauterizing the two cut ends. However, this tool provides little compression for actually forming the cut ends, and it leaves the ends in less than desirable shapes, e.g., usually flared.

Accordingly, what is needed are improved tools and techniques for cutting, cauterizing and compressing multi-strand plastic fiber materials.

DISCLOSURE OF INVENTION

Accordingly, it is an object of the present invention to provide an instrument for crimping, cutting, and cauterizing multi-strand plastic materials.

Another object of the invention is to provide an instrument which is easy to use in essentially a one-handed manner, to form and cut quantities of multi-strand plastic materials in a consistent manner.

Another object of the invention is to provide an instrument which creates aesthetically pleasing ends to the cuts of multi-strand plastic materials.

And, another object of the invention is to provide an instrument for crimping, cutting, and cauterizing multi-strand plastic material which is safe.

Briefly, one preferred embodiment of the present invention is an instrument for cutting multi-strand plastic material. Provided are first and second jaws which are respectively attached to first and second arm members with a pivot, so the jaw members can be manually positioned together or apart. Formed in the first and second jaw parts are a cavity for holding, crimping, and compressing the material. This cavity is located between first and second mating surfaces respectively located in the first and second jaw parts. A cutting feature is provided for cutting the multi-strand plastic material. And a heating feature is provided for applying heat to mold the multi-strand plastic material within the cavity, to crimp the material, and to and cauterizing the end of the material during operation of the invention.

An advantage of the present invention is that it may be implemented as a single hand-held instrument, permitting crimping, cutting, and cauterizing all in one simple manual operation. Because it is small and compact, when implemented as a hand-held instrument, it is easy to use and easy to store when not in use.

Another advantage of the invention is that it is much safer to use than present methods and apparatus used for the same purposes. Since it does not use a flame to apply heat to the working material, the overall risk of fire is reduced or eliminated. For example, synthetic rope is often used in nautical applications where diesel fuel and other flammable substances and fumes are present, and where the use of an open flame is too dangerous.

Further, operators of the instrument can avoid contact bums from hot surfaces, since the instrument can easily be implemented with suitable thermal insulation and only the working surfaces being heated. The instrument also removes any need for the operator to touch the working material while it is still hot. And similarly, the risk of bums to a proximate other party is also reduced (e.g., a hairdresser's client receiving synthetic hair braids), also by suitable thermal insulation and further by the inherent compactness and maneuverability of hand-held instruments in tight quarters.

And, another advantage of the invention is that it can be implemented with temperature sensing and control capabilities, to warn when it is too cold or too hot for appropriate operation, or to automatically control its temperature and keep it at an operating optimum. Thus, burning to the ends of the working material may also be reduced or eliminated.

These and other objects and advantages of the present invention will become clear to those skilled in the art in view of the description of the best presently known mode of carrying out the invention and the industrial applicability of the preferred embodiment as described herein and as illustrated in the several figures of the drawings.

BRIEF DESCRIPTION OF THE DRAWINGS

The purposes and advantages of the present invention will be apparent from the following detailed description in conjunction with the appended drawings in which:

FIG. 6*a* is top view of one complete half of the cutting instrument of a second embodiment of the invention, while

BEST MODE FOR CARRYING OUT THE INVENTION

Figure 1:
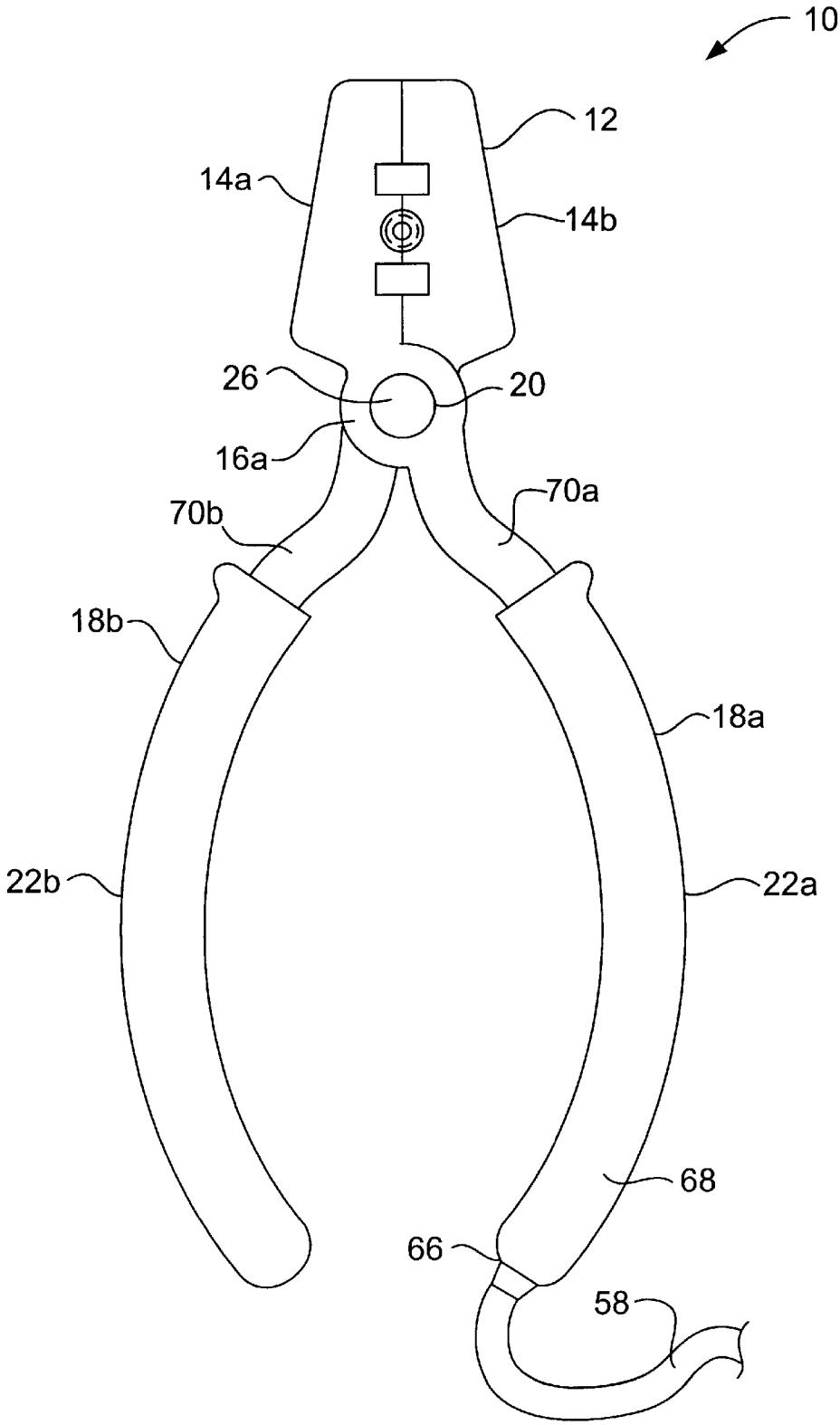
FIG. 1 is a top view of the cutting instrument of a first embodiment of the invention.

The preferred embodiment of the present invention is a hand-held cutting instrument for simultaneously cutting, cauterizing, and crimping multi-strand plastic materials such as braided synthetic hair and rope. The preferred embodiments of the cutting instrument are set forth in the figures herein, in which they are designated by the general reference character 10.

Referring to the top view of FIG. 1, in external appearance, the cutting instrument 10 bears resemblance to a number of common hand tools, such as those of the pliers family, and especially such having a cutting and/or crimping capability. The cutting instrument 10 includes a working end 12, which is comprised of a paired first jaw part 14*a* and second jaw part 14*b*. These jaw parts (14*a* and 14*b*) are angularly offset towards each other from a first pivot portion 16*a* and second pivot portion 16*b* (FIG. 4), respectively, so as to extend in a common plane. A first arm member 18*a* and second arm member 18*b* are also provided, and are movable in lever-like manner relative to one another about a pivot joint 20 to open and close the jaw parts (14*a* and 14*b*) in a conventional application of mechanical advantage.

Figure 2:
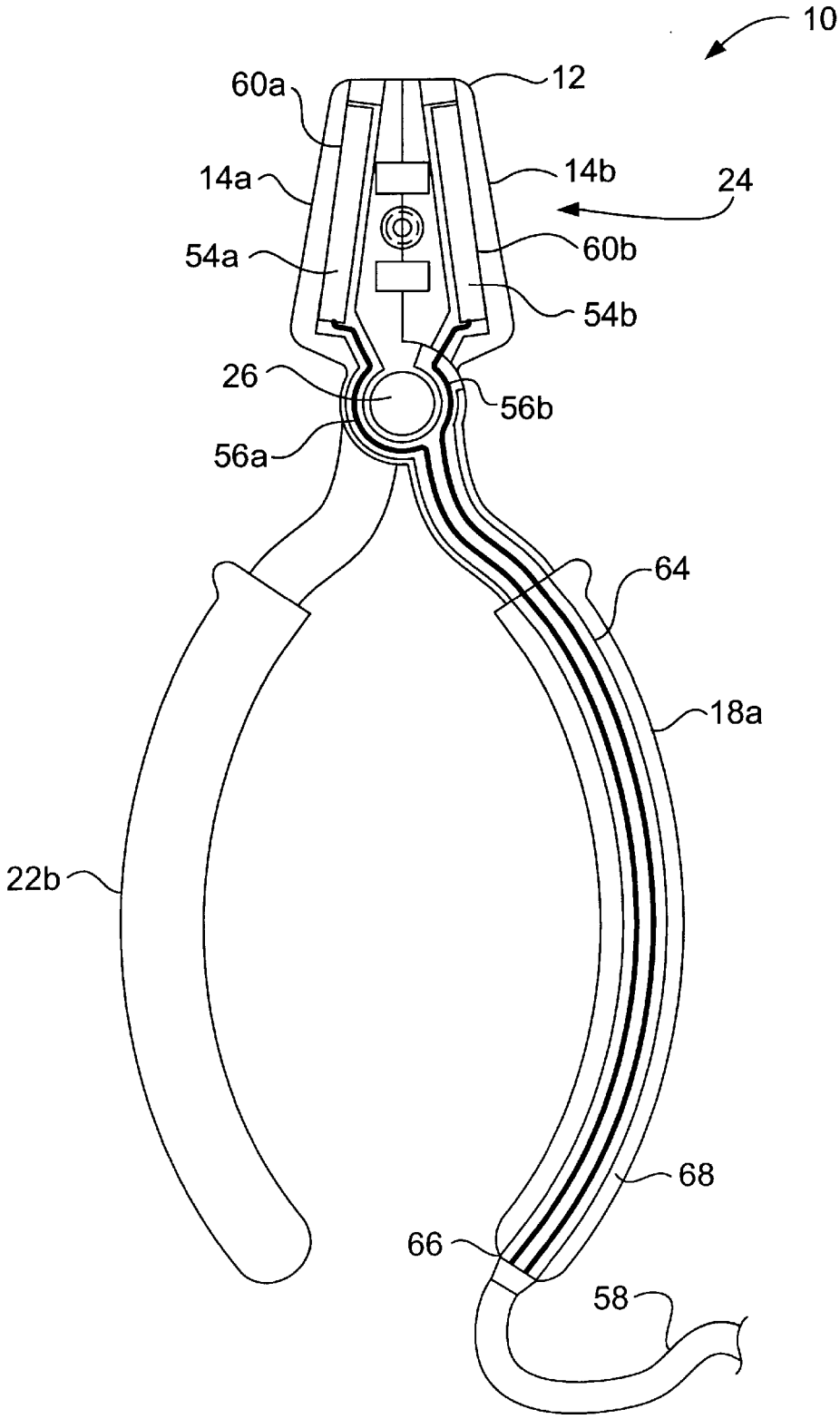
FIG. 2 is a transparent top view of the embodiment of FIG. 1.

As depicted particularly in FIGS. 1–2, the arm members (18*a* and 18*b*) may be elongated and configured in an opposing arcuate style to afford a first handle portion 22*a* and a second handle portion 22*b* for comfortable holding and operation of the cutting instrument 10. A resilient plastic material (applied with heat shrinking or dipping, etc.) covers the handle portions (22*a* and 22*b*) to provide thermal insulation and to reduce friction to the user's hand and thereby improve comfort.

As depicted in FIGS. 1–3 and 5, the paired first jaw part 14*a* and second jaw part 14*b* may be gradually tapering, which reduces weight in the working end 12 and facilitates use of the cutting instrument 10 in tight locations. However, this shape is not a requirement and may not be desired in some cases (as is discussed below for an alternate embodiment).

Not depicted in the figures, but in relatively conventional manner, the working end 12 may be provided with a non-stick plastic coating (e.g., TEFLON, TM) to also provide thermal insulation, as well as a resilient surface and more attractive appearance.

Referring now particularly to the transparent view of FIG. 2, internally this embodiment of the cutting instrument 10 departs from common hand tools by also including a heating assembly 24. The heating assembly 24, which will be described in more detail below, heats one or both of the jaw parts (14*a* and 14*b*) to a temperature sufficient to cauterize (i.e., partially melt and fuse) thermoplastic stranded materials. In the following discussion braided synthetic hair is the example primarily used, but the inventive cutting instrument 10 may be used on many other multi-strand plastic materials as well.

The cutting instrument 10 may be constructed in the well known manner of machining the jaw parts (14*a* and 14*b*) and arm members (18*a* and 18*b*) (and pivot joint 20) from two steel pieces later arranged in crossing fashion. That is, the jaw parts (14*a* or 14*b*) may be integral extensions of the arm members (18*a* or 18*b*). Alternatively, the working end 12 and the arm members (18*a* and 18*b*) may be separately fashioned and then joined together by conventional fastening methods.

In any event, there are present the generally planar pivot portions (16*a* and 16*b*) which are located intermediate the jaw parts (14*a* and 14*b*) and the arm members (18*a* and 18*b*). The pivot portions (16*a* and 16*b*) are fashioned to reside in mutually overlying, sliding relationship and include the aforementioned pivot joint 20, which is comprised of a rivet or pivot pin 26 seated in apertures (not shown) present in the pivot portions (16*a* and 16*b*). As with pliers and most similar tools, the pivot portions (16*a* and 16*b*) here provide that the jaw parts (14*a* and 14*b*) and arm members (18*a* and 18*b*) are all substantially coplanar, despite the laterally offset relation that each jaw part (14*a* or 14*b*) bears to its respective operating arm member (18*a* or 18*b*).

Figure 3:
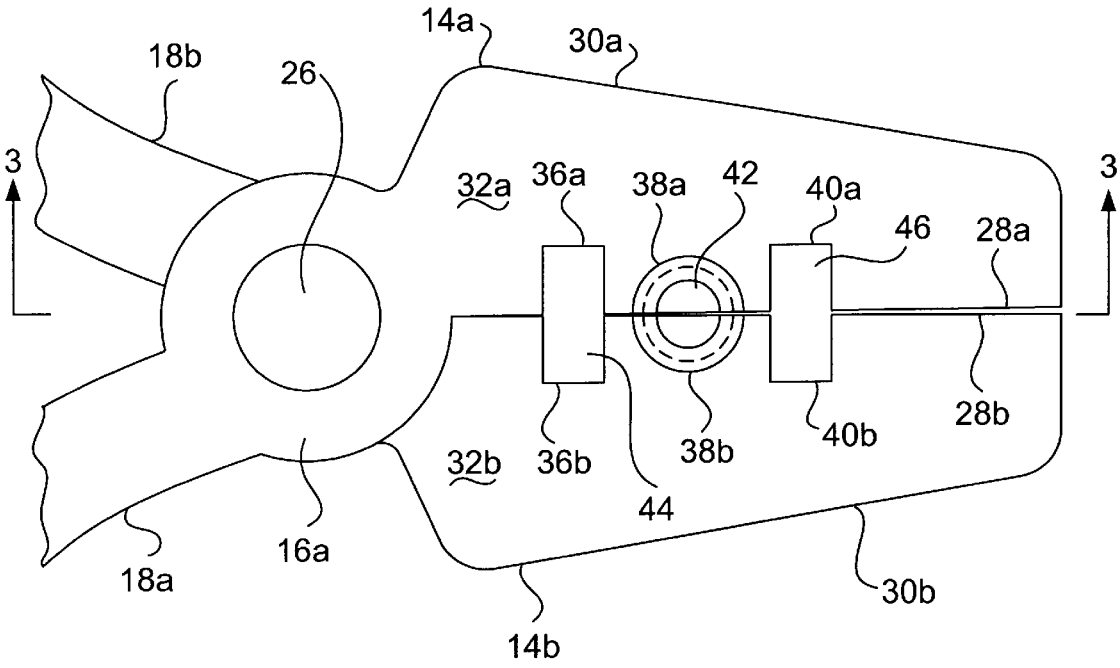
FIG. 3 is a top view of the working end of the embodiment of FIG. 1, with the arm members broken away.

As best shown in FIG. 3, the specialized jaw parts (14*a* and 14*b*) may each be a mirror image of the other, and include opposing, longitudinally extending first mating surface 28*a* and second mating surface 28*b*, outer lateral first edge 30*a* and second edge 30*b*, first top surface 32*a* and second top surface 32*b*, and first bottom surface 34*a* (FIG. 4) and second bottom surface (not shown). The mating surfaces (28*a* and 28*b*) are swingably positionable toward and away from each other upon pivotal movement of the arm members (18*a* and 18*b*), in order to opposably engage a braid of synthetic hair there between.

Within the mating surfaces (28*a* and 28*b*) are present, in opposing and facing relation, three sets of spaced apart recesses or notches. These are herein termed a first proximal recess 36*a* and second proximal recess 36*b*, a first medial recess 38*a* and second medial recess 38*b*, and a first distal recess 40*a* and second distal recess 40*b*, respectively. Of these, the pair of medial recesses (38*a* and 38*b*) together form a transversely oriented crimping and cutting cavity 42 (i.e., a die) when the jaw parts (14*a* and 14*b*) are brought into the abutting, closed position. Similarly, the notches denoted by the paired proximal recesses (36*a* and 36*b*) and the paired distal recesses (40*a* and 40*b*) form apertures which act as a proximal relief 44 and a distal relief 46, respectively (the importance of which is described shortly).

Figure 4:
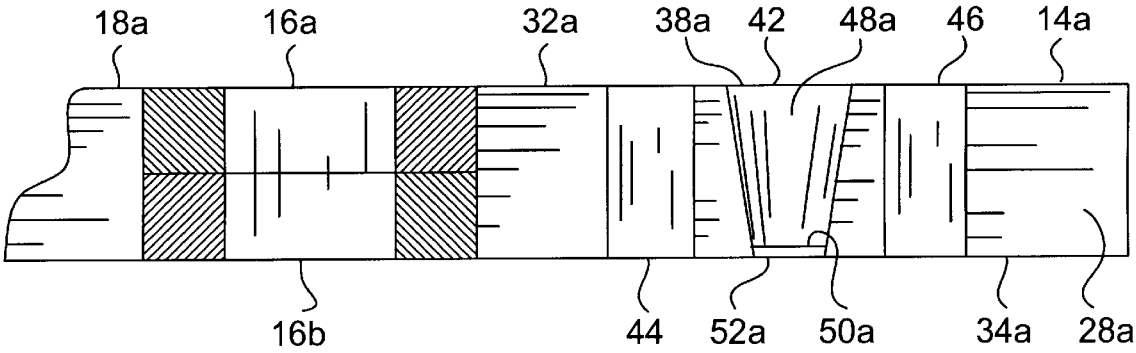
FIG. 4 is a side view taken along line 3—3 of FIG. 3 illustrating the crimping and cutting cavity, and other features of the embodiment of FIG. 1.

With reference now to the side view of FIG. 4, the cavity 42 comprises a plurality of surfaces. Included are a paired first cavity wall surface 48*a* and second cavity wall surface (not shown) which taper together to form the cavity 42. At the bottom of the cavity 42, at the narrowest part of the taper, are a first cavity bottom portion 50*a* and second cavity bottom portion (not shown), respectively. Each cavity wall surface (48*a* or its mate) is thus one-half of a generally frustoconical shape, which in use cause the braids of synthetic hair fibers to be molded together and cauterized into a neatly tapered shape when captured and squeezed within the medial recesses (38*a* and 38*b*) of the heated jaw parts (14*a* and 14*b*) forming the cavity 42.

The pair of cavity wall surfaces (48*a* and its mate) may also, when brought together, afford a shape other than frustoconical. For example, a right circular cylindrical shape, an hourglass shape, an undulating shape, a spherical shape, or a beaded shape (an example used in another embodiment presented below) are all possibilities, among myriad other shapes for the crimping and cutting cavity 42. Indeed, a single cutting instrument 10 may include two or more crimping and cutting cavities, similar to cavity 42 but with differing shapes, to offer a variety of crimped shapes in a single tool. A single cutting instrument 10 may also be provided with two or more crimping and cutting cavities like cavity 42 where those cavities have the same shape but are of different sizes in order to accommodate differently sized braids of synthetic hair.

From the cavity bottom portions (50*a* and its mate) are respectively formed a first cutting edge 52*a* and a second cutting edge not shown, which are coplanar and naturally longitudinally coextensive when the jaw parts (14*a* and 14*b*) are in the closed position. The cutting edges (52*a* and its mate) may be beveled or otherwise ground to a relatively sharp state. Being coplanar, the cutting edges (52*a* and its mate) converge to pinchingly and cuttingly engage each other when pivoted, and thus cut synthetic materials in a manner closely analogous to the cutting operation performed by pliers of the wire-cutting variety. Upon application of the afforded mechanical leverage not only is the synthetic braid of hair crimped and cauterized within the crimping and cutting cavity 42, as described above, but the braid is cut as well—with all three events occurring roughly simultaneously.

It is readily apparent also that other arrangements for the cutting mechanism of the cutting instrument 10 are possible. For example, the cutting elements might not be coplanar as shown in the preferred embodiments, but rather offset so that they slidingly overlay to cut like a pair of scissors. Further, only one primary cutting element may be used, with what was the other being fashioned as a coplanar "anvil" (i.e., a non-cutting surface or structure generally) against which the synthetic material may be held and cut; or over which the single cutting element may slidingly pass to make a cut where the cutting element and anvil are juxtaposedly offset (e.g., a guillotine type of cutting action); or into which the single cutting element may insertably wedge to make the cut (i.e., into a V-shape or syncline).

Referring now also again to FIG. 3, the previously mentioned proximal relief 44 and distal relief 46 each may have an open-ended, generally rectangular or cuboidal shape, with each set of paired proximal recesses (36*a* and 36*b*) forming the proximal relief 44 and each set of paired distal recesses (40*a* and 40*b*) forming the distal relief 46. In some embodiments the paired proximal relief 44 and distal relief 46 are of some importance, since it has been discovered that without such being located proximate to the cavity 42 that crimping and cauterization of the braid is not as consistent and uniform as desired. This is attributed to the proximal relief 44 and distal relief 46 reducing the mass of metal comprising the jaw parts (14*a* and 14*b*) in the immediate vicinity of the cavity 42, yet acting to more evenly focus and concentrate that heat which is supplied by the heating assembly 24.

While the proximal relief 44 and distal relief 46 of the embodiments shown have a generally rectangular shapes, it is believed that at least some improvement in heating efficiency and quality of cauterization and molding of the braids may be obtained with other shapes.

Figure 5:
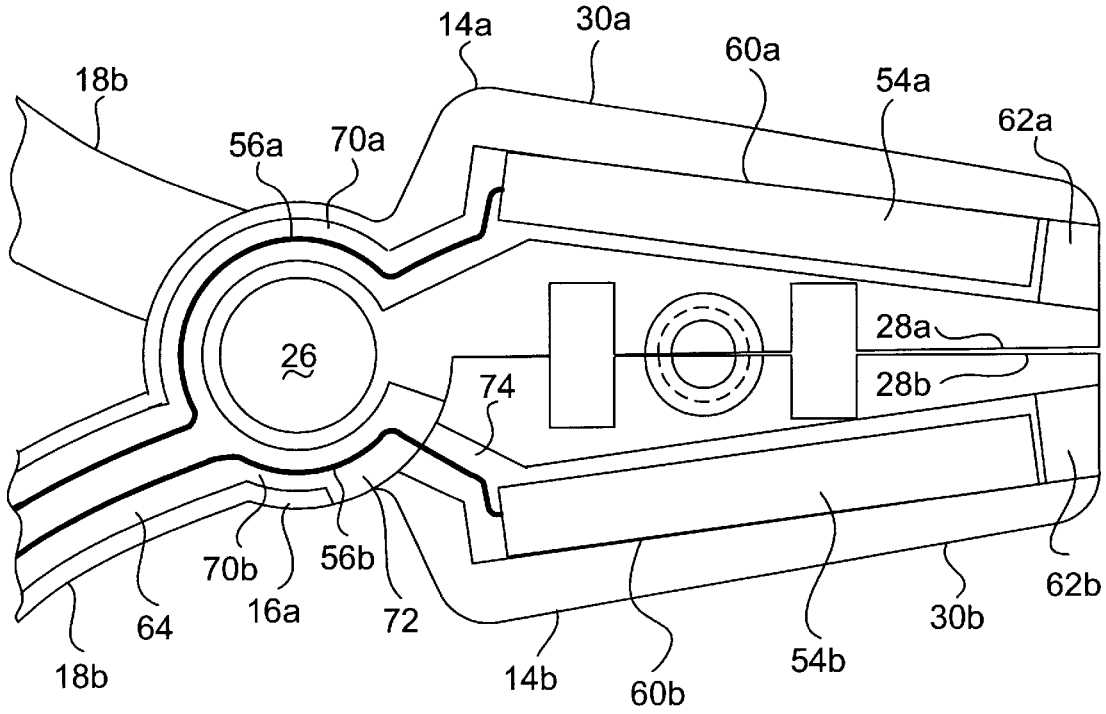
FIG. 5 is a transparent top view of the working end of the embodiment of FIG. 1, with the arm members broken away.

As will have been previously noted in FIG. 2, and with reference now again to that drawing and especially also to the (enlarged) partial view of FIG. 5, the heating assembly 24 may include a paired resistance-type first heating element 54*a* and second heating element 54*b*, a paired first conductor 56*a* and second conductor 56*b* (e.g., each conventional insulated electrical cable), an insulated power supply cable 58, and a power supply (not shown) having a variable current control to vary the temperature. In this embodiment, the electrical connection between the cutting instrument 10 and the power supply is advantageously made by means of a single cable connection (i.e., the power supply cable 58) through only one of the two handle portions (22*a* and 22*b*), as described below. This permits a freer use of the cutting instrument 10 without the entanglement and hindrance which would inevitably be created by having electric cable connections departing from both of the handle portions (22*a* and 22*b*). The manner in which the components of the heating assembly 24 are incorporated into the cutting instrument 10 now follows.

As best shown in FIG. 5, the first and second jaw parts (14*a* and 14*b*) are provided with a longitudinally extending first chamber 60*a* and second chamber 60*b* (e.g., internal bores or channels), located intermediate the outer lateral edges (30*a* and 30*b*) and their corresponding mating surfaces (28*a* and 28*b*). These chambers (60*a* and 60*b*) are further located approximately equidistant from the top surfaces (32*a* and 32*b*) and bottom surfaces (34*a* and its mate) (FIG. 3 and FIG. 4) of the jaw parts (14*a* and 14*b*), running substantially along their length and sized to receive the heating elements (54*a* and 54*b*) therein. In this embodiment, a first plug 62*a* and a second plug 62*b* are also provided, to seal the distal ends of the chambers (60*a* and 60*b*).

With reference now back to FIG. 2, the first arm member 18*a* is also provided with a longer conduit 64 which extends from a proximal opening 66 in arm member end 68 to the first pivot portion 16*a*, where this conduit 64 bifurcates into a first branch 70*a* and a second branch 70*b*, respectively. The first branch 70*a* curves in semi-circular fashion about the pivot pin 26 and then continues linearly through the jaw part 14*a* to intersect with the chamber 60*a*, with which the branch 70*a* is then made to be in open communication. The second branch 70*b* similarly follows a semi-circular path about an opposite side of the pivot pin 26 but then terminates in a recessed portion 72 (FIG. 5) which extends partially about the perimeter of the pivot portion 16*a*. The recessed portion 72 allows the second branch 70*b* to be in constant and continuous open communication with a conduit segment 74 which is present in the second jaw part 14*b* even as that jaw part 14*b* pivots with respect to the first pivot portion 16*a*.

The power supply cable 58 is attached by conventional appliance electrical cord fastening means at the proximal opening 66 and carries the conductors (56*a* and 56*b*) to this point. The conductors (56*a* and 56*b*) then continue through the conduit 64 to the pivot portion 16*a* where they separate to follow either the respective branches (70*a* or 70*b*). The first conductor 56*a* continues through the first branch 70*a* and to the first chamber 60*a* to be connected to the heating element 54*a* therein. The second conductor 56*b* continues on through the recessed portion 72, through the conduit segment 74 and on to the second chamber 60*b* where that conductor 56*b* is connected to the second heating element 54*b*.

Regulation of heating of the working end 12 of this embodiment is via a power supply with variable control (not shown). Generally, the operating temperature is in the vicinity of approximately 200 degree F. It should be readily appreciated that a thermocouple or similar temperature sensor, with the appropriate electronic circuitry, might also be incorporated into the cutting instrument 10 in at least one of the jaw parts (14*a* and 14*b*), in order to obtain a more precise temperature control.

Other variations may exist with respect to many of the features described for the embodiment of the cutting instrument 10 appearing in FIGS. 1–5. For example, with respect to the arm members (18*a* and 18*b*) and the handle portions (22*a* and 22*b*), those elements might be given the form of scissors handles, rather than pliers-type handles. Thus, one handle having a generally circular opening for insertion of the thumb of the user and a second handle having an elongated or elliptical opening for accommodation of other of the remaining fingers of the user could be provided.

Figure 6B:
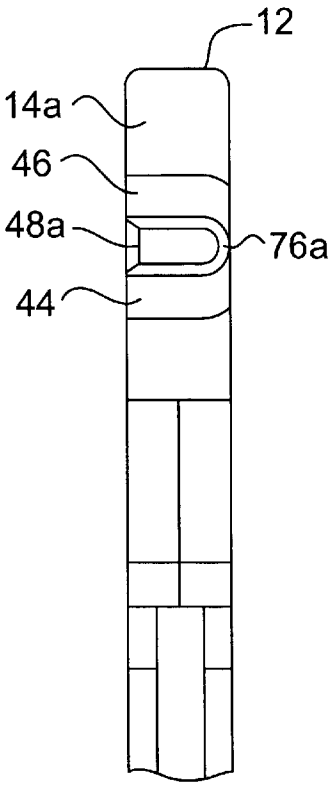
FIG. 6*b* is a partial right side view of FIG. 6*a* illustrating just the crimping and cutting cavity, and other jaw area features of the embodiment of FIG. 6*a*.
Figure 6A:
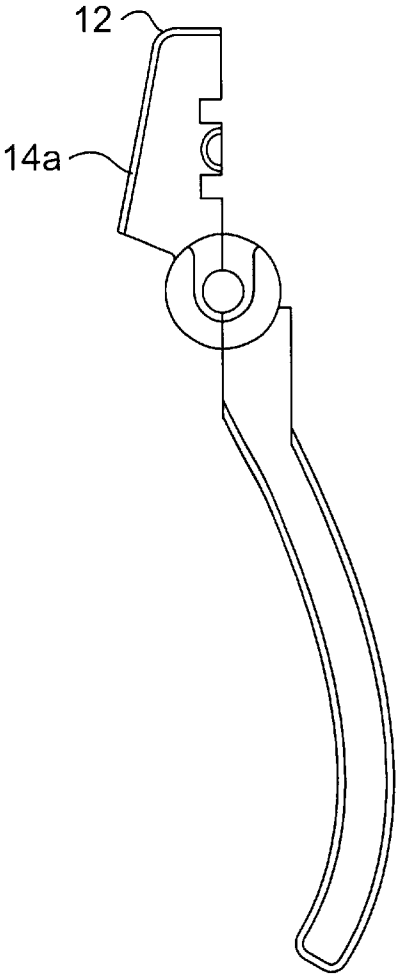

FIGS. 6*a*–*b* particularly depict an alternate embodiment of the cutting instrument 10. As can be seen in FIG. 6*a*, which is of only one mirror half of this embodiment of the invention, considerable similarity is retain to the embodiment previously discussed, above. The noteworthy differences are the absence of the integral heat source, the different shape of the working end 12, and the manner of cutting operation used.

An external heat source can be used to heat the cutting instrument 10, rather than an integral source such as the heating assembly 24. This eliminates the need for the heating assembly 24 and its attendant conductors (56*a* and 56*b*), power supply cable 58, chambers (60*a* and 60*b*), plugs (62*a* and 62*b*), conduit 64, etc. Instead conventional and widely available external heating means like conduction and convection ovens, optical radiation (e.g., heat lamps), electromagnetic radiation (e.g., radio frequency eddy current induction), and even still other heating means may be employed.

The shape of the working end 12, particularly visible in FIG. 6*a*, may deliberately be made larger and more symmetrical, overall, than in the embodiment shown in FIG. 1. It has been the inventor's observation that the material, and its thermal energy absorbing and conducting abilities, affect the functionality of the cutting instrument 10. Further, this is particularly the case when an external heat source is used, since the cutting instrument 10 may cool somewhat between removal from the heat source and application. Thus, the large first jaw part 14*a* in FIG. 6*a* acts as a heat reservoir, and the rectangular shape acts to uniformly conduct thermal energy to all sides of the first cavity wall surface 48*a*.

The manner of cutting operation was previously described as using at least one of the cutting edges (52*a* and 52*b*) of the first described embodiment. However, in view of the plastic nature of the material being cut and the availability of heat during cutting, this operation can be performed without using any "sharp edges" in the conventional sense. FIG. 6*b* illustrates a first pinching surface 76*a*, located in the first jaw part 14*a*, which mates with a second pinching surface (not shown). When the jaw parts (14*a* and 14*b*) are forcibly brought together by a user squeezing the handles, the pinching surfaces (76*a* and its mate) melt through the synthetic hair material, thus effectively cutting it. It should also be noted, that to facilitate this melt-cut action the pinching surfaces (76*a* and its mate) may intentionally be made much narrower than the walls between the respective proximal recesses (36*a* and 36*b*), the medial recesses (38*a* and 38*b*), and the distal recesses (40*a* and 40*b*). FIG. 6*b* illustrates this, showing the pinching surfaces (76*a* and its mate) both being consistently narrow along their operating portions.

In addition to the above-mentioned examples, it is to be understood that various other modifications and alterations with regard to the types of materials used, their method of joining and attachment, and the shapes, dimensions and orientations of the components as described may be made without departing from the scope of the invention.

INDUSTRIAL APPLICABILITY

The cutting instrument 10 of the preferred embodiment of the present invention is designed to be used in the commercially popular hairstyling process of supplementally braiding synthetic hair into natural hair. Generally, however, the cutting instrument 10 may also be used with respect to the cutting of any thermoplastic strand or fiber material, including synthetic ropes, yarns, etc., in order to prevent the ends of such material from unraveling after cutting. Thus, different embodiments of the cutting instrument 10 may have application in fields as diverse as hairstyling, sewing, and sailing.

Use of the cutting instrument 10 is simple. As used in the hair braiding/extension process, the cutting instrument 10 is typically employed as follows: After the braid of synthetic hair has been attached to the natural hair, a determination is made as to the final length of the extension desired. With the cutting instrument 10 having been connected to the power supply and the working end 12 having been heated to the operating temperature, the braid is positioned within the opened jaw parts (14*a* and 14*b*) between the medial recesses (38*a* and 38*b*). The cutting instrument 10 is then moved up or down along the braid, as necessary, to place the cutting edges (52*a* and its mate) in alignment with the visually determined final hair length. The arm members (18*a* and 18*b*) are then squeezed together, during which process the braid begins to be heated and fused within the crimping and cutting cavity 42. At such point as the mating surfaces (28*a* and 28*b*) have been opposably and coextensively engaged, the selected portion of the braid is cut through by the cutting edges (52*a* and its mate) with the lower end of the attached braid having been neatly molded and cauterized.

The cutting of synthetic hair braids by the cutting instrument 10 is extremely expeditious compared to the conventional method of using a cigarette lighter and one's fingers. Thus, there is a significant savings in the amount of time that the hair stylist must spend with the customer, which in turn means that a greater number of customers may be treated during a given day. It is also expected to make the process less expensive for the customer as well.

The present method is safer and more comfortable as well, for both the hairstylist and the customer, with no danger of hair or material catching on fire or being singed, no emission of noxious fumes from burning plastic, and no burning of the hairstylist's fingers.

For the foregoing reasons, and for numerous others as set forth previously herein, it is expected that the industrial applicability and commercial utility of the present invention will be extensive and long lasting.

What is claimed is:

1. An instrument for cutting multi-strand plastic material, comprising:

a first jaw part attached to a first arm member;

a second jaw part attached to a second arm member;

pivot means for attaching said first and second arm members in pivotally movable manner such that said jaw members can be manually positioned together and also positioned apart;

crimping means for compressably holding the multi-strand plastic material, wherein said crimping means is located in said first and second jaw parts;

said crimping means including at least one cavity formed between a first wall surface located in a first mating surface in said first jaw part and a second wall surface located in a second mating surface in said second jaw part, to facilitate controllably directing into place and capturing the multi-strand plastic material;

cutting means for cutting the multi-strand plastic material;

heat applying means for molding the multi-strand plastic material within said cavity of said crimping means and cauterizing the multi-strand plastic material during operation of said cutting means;

heat concentrating means for directing the heat from said heat applying means into said crimping means; and said heat concentrating means including at least one relief formed by a first recess located in said first mating surface and a second recess located in said second mating surface, to retard the flow of heat away from said crimping means elsewhere into said first and second jaw parts.

2. The instrument of claim 1, wherein:

said crimping means includes a plurality of said cavities suitably sized for use of the instrument on differing amounts of the multi-strand plastic material.

3. The instrument of claim 1, wherein:

said crimping means includes a plurality of said cavities suitably shaped for use of the instrument to provide alternate shaping to ends of the multi-strand plastic material.

4. The instrument of claim 1, wherein:

said cavity has a frustoconical shape, open at the base end of said frustoconical shape and ending with the frustum end at said cutting means, to provide a tapered end to the multi-strand plastic material after it is compressed, cut, and cauterized by the instrument.

5. The instrument of claim 1, wherein:

said cavity has a horseshoe shape, to provide a rounded end to the multi-strand plastic material after it is compressed, cut, and cauterized by the instrument.

6. The instrument of claim 1, wherein:

said cutting means includes a first projection located in said first jaw part and a second projection located in said second jaw part, to melt through and pinchably cut the multi-strand plastic material using heat from said heat applying means.

7. The instrument of claim 1, wherein:

said cutting means includes a first blade portion located in said first jaw part and said second jaw part includes one member of the set consisting of a second blade portion, an anvil portion, a syncline, and a guillotine chamber, to cut the multi-strand plastic material therebetween.

8. The instrument of claim 1, wherein:

said heat applying means includes a heat reservoir suitable for receiving thermal energy from a heat source external to the instrument and temporarily storing said thermal energy until the instrument is used on the multi-strand plastic material.

9. The instrument of claim 1, wherein:

said heat applying means includes at least one electrical heating element located in at least one member of the set consisting of said first jaw part and said second jaw part.

10. The instrument of claim 9, further comprising:

temperature sensing means for detecting the temperature of said crimping means; and reporting means for apprising a user when said crimping means is at a suitable operating temperature.

11. The instrument of claim 9, further comprising:

temperature sensing means for detecting the temperature of said crimping means; and controlling means for controlling said electrical heating element to bring to and maintain said crimping means at a suitable operating temperature.

12. The instrument of claim 1, wherein:

said heat concentrating means includes two said reliefs, one located on the distal side of said crimping means and the other located on the proximal side of said crimping means, relative to the length of the instrument when held by a user.

* * * * *